US009322377B2

(12) United States Patent
Matsui et al.

(10) Patent No.: US 9,322,377 B2
(45) Date of Patent: Apr. 26, 2016

(54) RECOIL STARTER MECHANISM

(71) Applicants: Satoshi Matsui, Tokyo (JP); Taro Kihara, Tokyo (JP)

(72) Inventors: Satoshi Matsui, Tokyo (JP); Taro Kihara, Tokyo (JP)

(73) Assignee: STARTING INDUSTRIAL CO., LTD., Tokyo (JP)

( * ) Notice: Subject to any disclaimer, the term of this patent is extended or adjusted under 35 U.S.C. 154(b) by 296 days.

(21) Appl. No.: 13/716,976

(22) Filed: Dec. 17, 2012

(65) Prior Publication Data

US 2013/0152896 A1 Jun. 20, 2013

(30) Foreign Application Priority Data

Dec. 19, 2011 (JP) ..... 2011-277354

(51) Int. Cl.
*F02N 3/02* (2006.01)

(52) U.S. Cl.
CPC ..... *F02N 3/02* (2013.01)

(58) Field of Classification Search
CPC ..... F02N 3/02; F02N 5/02
USPC ..... 123/185.1–185.4; 185/45
See application file for complete search history.

(56) References Cited

U.S. PATENT DOCUMENTS 4,068,644 A * 1/1978 Newport ..... 123/185.3
4,370,954 A * 2/1983 Asao ..... F02N 3/02 123/182.1
7,028,658 B2 * 4/2006 Kruse et al. ..... 123/185.3
7,650,868 B2 * 1/2010 Fujita et al. ..... 123/185.14
2004/0250786 A1 12/2004 Kruse et al.
2009/0282819 A1 * 11/2009 Kashima ..... F01L 13/08 60/317
2010/0170465 A1 * 7/2010 Eakins, Jr. ..... 123/185.3
2010/0206259 A1 * 8/2010 Nieda et al. ..... 123/185.3

FOREIGN PATENT DOCUMENTS

CN 1757904 4/2006
CN 101230822 7/2008
EE 2066782 C1 * 9/1996
JP 50-7378 3/1975
JP 52-48743 4/1977

(Continued)

OTHER PUBLICATIONS

Chinese Office Action dated Jul. 2, 2015 issued in Chinese Patent Application No. 201210553454.2 and English translation, 13 pp.

(Continued)

*Primary Examiner* — Hung Q Nguyen
*Assistant Examiner* — Josh Campbell
(74) *Attorney, Agent, or Firm* — Nixon & Vanderhye P.C.

(57) ABSTRACT

One embodiment provides a recoil starter mechanism, including: a starter case having a rotation shaft; a rope reel rotatably mounted on the rotation shaft; a coil spring wound on the rotation shaft, one end thereof being formed into a tip projecting portion; a hold plate holding the coil spring to the rotation shaft; and a ratchet which is formed into a ring-like shape and interposed between the rope reel and the hold plate. The ratchet includes: a fulcrum around which the ratchet is swingable with respect to the rope reel; a guide groove in which the tip projecting portion is engaged; and an engagement pawl which is to be engaged with an engagement portion of a pulley to thereby start an engine. The guide groove and the engagement pawl are disposed at opposite sides so as to interpose the rotation shaft therebetween.

4 Claims, 6 Drawing Sheets

(56) References Cited

FOREIGN PATENT DOCUMENTS

| | | | |
|---|---|---|---|
| JP | 52-48744 | | 4/1977 |
| JP | 53-8818 | | 3/1978 |
| JP | 55-158276 | | 5/1979 |
| JP | 55-23316 | | 2/1980 |
| JP | 59-30217 | | 8/1984 |
| JP | 59-030217 | A * | 8/1984 |
| JP | 5930217 | * | 8/1984 |
| JP | 63-289260 | | 11/1988 |

OTHER PUBLICATIONS

Japanese Office Action dated Aug. 18, 2015 issued in Japanese Patent Application No. 2011-277354 and English translation, 3 pp.

* cited by examiner

RECOIL STARTER MECHANISM

CROSS-REFERENCE TO RELATED APPLICATION(S)

This application claims priority/priorities from Japanese Patent Application No. 2011-277354 filed on Dec. 19, 2011, the entire contents of which are herein incorporated by reference.

FIELD

The present invention relates to a recoil starter mechanism for a small engine.

BACKGROUND

For example, a recoil starter is provided to a small engine. The recoil starter includes a spring for rewinding a rope onto a rope reel by the restoring force thereof. For example, in the recoil starter of JP-UM-S59-030217-B, the rope reel (4, corresponding to the reference numeral in JP-UM-S59-030217-B) is rotatably mounted on a rotation shaft (3), and a ratchet (10) is rotatably mounted on the rope reel (4). The ratchet (10) is rotatably mounted on the rope reel (4) at its one end portion, and the other end portion of the ratchet (10) is formed into an engagement pawl. When the rope (7) is pulled to start the engine, the rope reel (4) is rotated, and the ratchet (10) is also rotated. As the ratchet (10) rotates, the engagement pawl is projected outwardly to be engaged with an engagement portion formed in a pulley (1) which is directly coupled to the engine. Thus, the rope reel (4) and the ratchet (10) rotate together with the pulley (1), thereby starting the engine.

In JP-UM-S59-030217-B, a coil spring (5) is disposed onto the rotation shaft (3), and a tip end (5*a*) of the coil spring (5) is engaged with a guide groove (10*a*) formed in the ratchet (10). The guide groove (10*a*) includes a peripherally-extending portion and a radially-extending portion, thereby forming a substantially L-like shape. Since the coil spring (5) is in a compressed state so as not to easily rotate, in the initial stage of the rotation of the rope reel (4), the tip end (5*a*) of the coil spring (5) moves along the peripherally-extending portion of the guide groove (10*a*), and does not causes the rotation of the ratchet (10). However, after the tip end (5*a*) of the coil spring (5) reaches the end of the peripherally-extending portion, it cannot further move in the same direction. Then, the ratchet (10) is caused to outwardly swing from the rope reel (4) such that the engagement pawl thereof projects outwardly to engage with the engagement portion of the pulley (1). Thus, the pulley (1) is also caused to rotate, thereby starting the engine. By releasing the rope (7), the rope reel (4) is reversely rotated by a return spring (6), and is caused to rotate reversely relative to the pulley (1). Thus, the ratchet (4) is also caused to swing reversely back to its initial position while the tip end (5*a*) of the coil spring (5) moves along the peripherally-extending portion of the guide groove (10*a*).

For example, the above-mentioned recoil starter may be provided to a snowmobile etc. The snowmobile etc. performs a backward movement by reversing the rotation of its engine. Usually, even if such reverse rotation of the engine is performed, there may be caused no particular adverse effect to the above-mentioned recoil starter as long as the ratchet (10) is in its initial position and is separated from the pulley (1) which is directly coupled to the engine. However, if the rope (7) is pulled in error during the backward movement, there may be caused a problem.

In JP-UM-S59-030217-B, since the L-shaped guide groove (10*a*) is short, the ratchet (10) can easily be brought from the initial position into the engagement position in which the engagement pawl engages with the engagement portion of the pulley (1). Therefore, when the rope (7) is pulled during the backward movement in which the engine reversely rotates, the ratchet (10) may engage with the pulley (1). In this case, the rope reel (4) is reversely rotated to thereby pull the rope (6) back into the recoil starter. Thus, the components may be damaged, and the safety problem may occur.

SUMMARY

One object of the present invention is to provide a recoil starter mechanism for a small engine which, even when a rope is pulled while a pulley directly coupled to an engine reversely rotates, can effectively prevent a rope reel from rotating reversely, thereby preventing the damage to the components and the occurrence of the safety problem.

In a preferred embodiment, a recoil starter mechanism includes:

a starter case (4);

a rotation shaft (5) which projects from the starter case (4);

a rope reel (6) which is rotatably mounted on the rotation shaft (5);

a coil spring (7) which is wound on the rotation shaft (5), one end of the coil spring (7) being formed into a tip projecting portion (16);

a hold plate (13) which is provided at a tip end portion of the rotation shaft (5) to thereby hold the coil spring (7) toward a base-side portion of the rotation shaft (5); and a ratchet (17) which is formed into a ring-like shape and interposed between the rope reel (6) and the hold plate (13), the ratchet (17) including:

a fulcrum (18) around which the ratchet (17) is swingable with respect to the rope reel (6);

a guide groove (20) including a first guide portion (20*a*) extending in a circumferential direction with respect to the rotation shaft (5) and a second guide portion (20*b*) extending in a radial-outward direction with respect to the rotation shaft (50), the tip projecting portion (16) being engaged with the guide groove (20) with a sliding resistance therebetween; and an engagement pawl (21) which is to be engaged with an engagement portion (3) of a pulley (1) to thereby start an engine, the guide groove (20) and the engagement pawl (21) being disposed at opposite sides so as to interpose the rotation shaft (5) therebetween.

The length of the first guide portion (20*a*) may be set such that a rotation angle ($\alpha$) of the rope reel (6) from an initial position to a swinging-start position in which the ratchet (17) starts swinging from the rope reel (6) is equal to substantially 50° or more.

length of the first guide portion (20*a*) is set such that a rotation angle ($\alpha$) of the rope reel (6) from an initial position to a swinging-start position in which the ratchet (17) starts swinging from the rope reel (6) is equal to substantially 50° or more.

A length of the second guide portion of the guide groove may be set such that a rotation angle ($\beta$) of the rope reel (6) from a swinging-start position in which the ratchet (17) starts swinging from the rope reel (6) to an engagement position in which the ratchet (17) engages with the pulley is equal to substantially 50° or more.

length of the second guide portion of the guide groove is set such that a rotation angle ($\beta$) of the rope reel (6) from a swinging-start position in which the ratchet (17) starts swinging from the rope reel (6) to an engagement position in which the ratchet (17) engages with the pulley is equal to substantially 50° or more.

The engagement portion (3) of the pulley (1) may be formed as a recessed groove (3), engagement portion (3) of the pulley (1) is formed as a recessed groove (3), wherein a tip end (21*a*) of the engagement pawl (21) of the ratchet (17) is formed into a rounded portion (21*a*) having a radius equal to substantially ½ of a depth (d) of the recessed groove (3) or more, and wherein an opening edge (3*a*) of the recessed groove (3) to be engaged with the engagement pawl (21) of the ratchet (17) is formed into a rounded portion (3*a*) having a radius equal to substantially ½ of the depth (d) of the recessed groove (3) or more.

According to a preferred embodiment, since the ratchet is formed into a ring-like shape and the guide groove and the engagement pawl are disposed at opposite sides so as to interpose the rotation shaft (5) therebetween, the length of the guide groove can be increased. Specifically, in the guide groove, the first guide portion for setting the time when the swinging movement of the ratchet is to be started and the second guide portion for setting the time when the ratchet is to be engaged with the pulley can be made longer, whereby the movement of the ratchet can be made slow as compared with the conventional structure. Therefore, even when the rope is pulled while the engine reversely rotates, the ratchet is prevented from immediately starting a swinging movement, thereby preventing the unintentional engagement of the ratchet to the recessed groove. This can prevent the damage to the components and the occurrence of the safety problem.

Since the length of the first guide portion of the guide groove may be set such that the rotation angle of the rope reel to bring the ratchet from the initial position to the swinging-start position in which the ratchet starts swinging from the rope reel is equal to substantially 50° or more, it takes a relatively long time for the ratchet to start the swinging movement after the rope is pulled. Therefore, even when the rope is pulled while the engine reversely rotates, the ratchet is prevented from immediately starting the swinging movement.

Since the length of the second guide portion of the guide groove may be set such that the rotation angle of the rope reel to bring the ratchet from the swinging-start position to the engagement position in which the ratchet engages with the pulley is equal to substantially 50° or more, the swinging movement of the ratchet can be made slow. Therefore, even when the rope is pulled while the engine reversely rotates, the ratchet is prevented from immediately swinging and engaging with the pulley.

Since the engagement portion of the pulley may be formed as a recessed groove, and each of the tip end of the engagement pawl and the opening edge of the recessed groove are formed into a rounded portion having a radius equal to substantially ½ of the depth of the recessed groove or more, when the starting rope is pulled while the engine reversely rotates, although the engagement pawl attempts to enter the recessed groove, it can be hit back through a collision between both the rounded portions, Thus, the ratchet and the pulley can be surely prevented from being engaged with each other,

DETAILED DESCRIPTION

An embodiment will be described with reference to the drawings.

Figure 1:
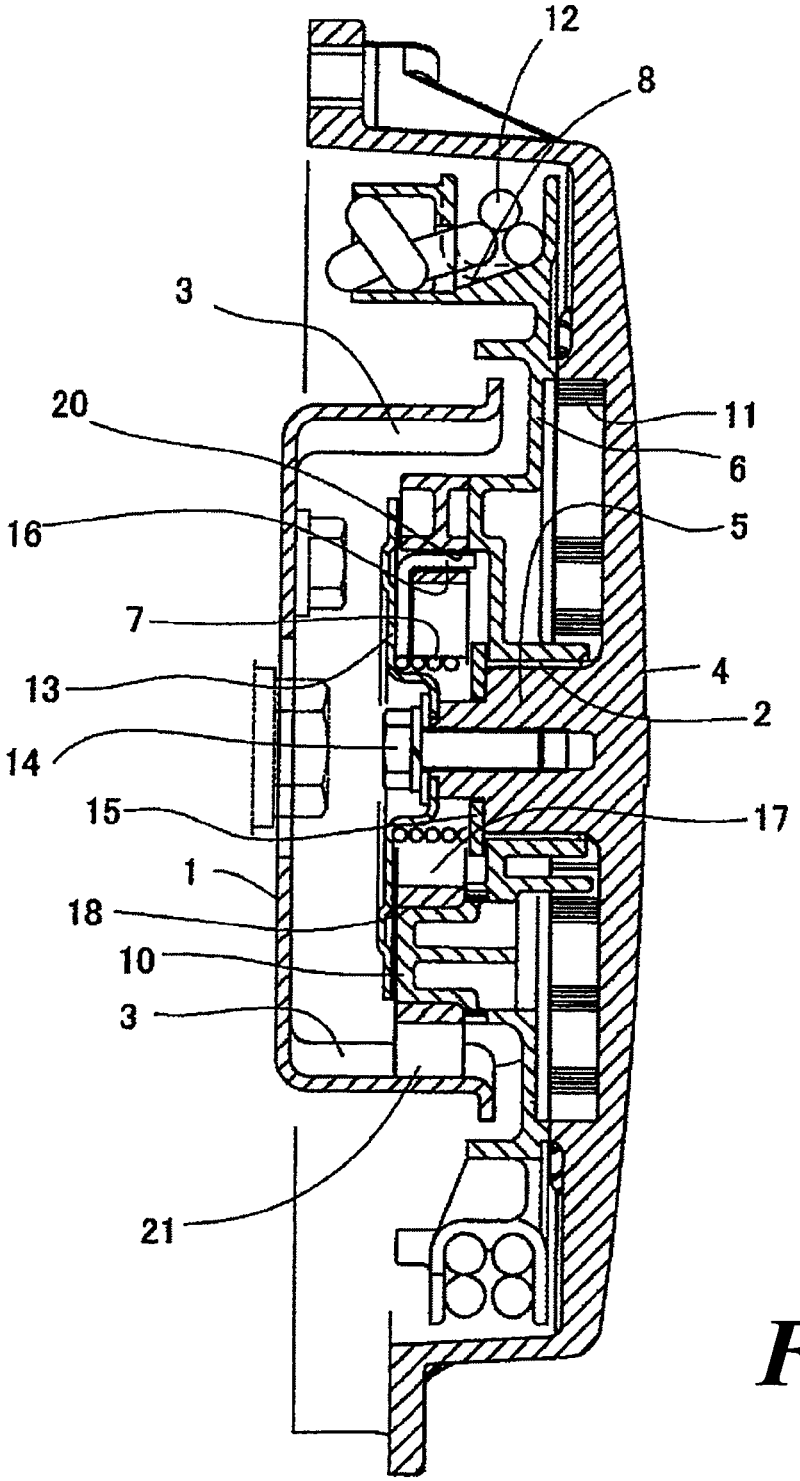
FIG. 1 is a longitudinal section view of a recoil starter mechanism according to an embodiment.
Figure 2:
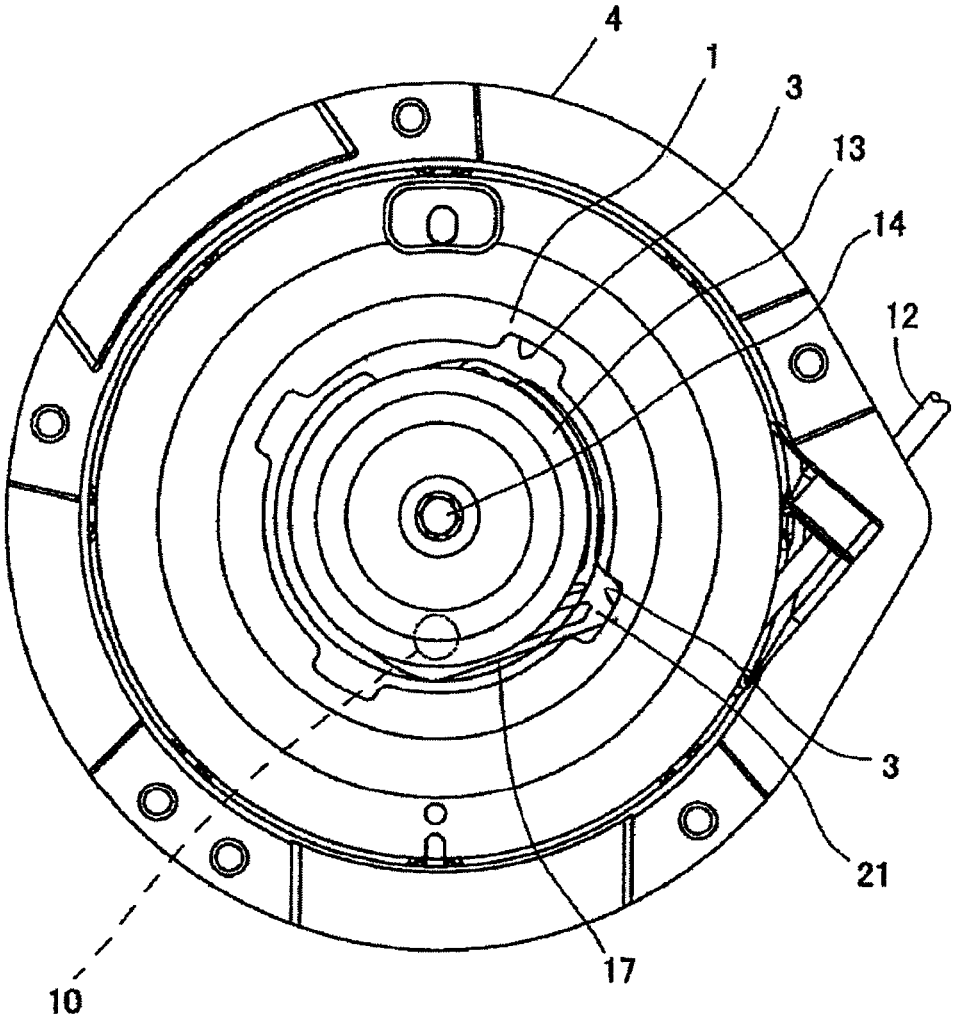
FIG. 2 shows the recoil starter mechanism from above.

FIG. 1 cross-sectionally shows a recoil starter mechanism according to the embodiment, and FIG. 2 shows the operation state of the recoil starter mechanism from above, a part thereof being cut out.

A pulley 1 is directly coupled to the engine of, for example, a snowmobile. The engine and the pulley 1 rotate together with each other. The pulley 1 has a dish-like shape and includes multiple recessed grooves (engagement portions) 3 formed in its inner peripheral surface. A rotation shaft 5 is provided inside a starter case 4 at a center thereof. A rotatable rope reel 6 is rotatably mounted on the rotation shaft 5, and a coil spring 7 is wound on the rotation shaft 5.

As shown in FIGS. 1 to 4, a bearing hole 2 is formed in the rope reel 6 at its central portion. The rope reel 6 includes a rope winding groove 8 formed in its outer peripheral portion, a recessed portion 9 provided at a part of its one surface, and a short shaft 10 provided on the same surface of the rope reel 6 at an opposite side with respect to the recessed portion 9.

A return spring 11 is provided to rewind a pulled-out rope into the winding groove 8 formed in the rope reel 6. A hold plate 13 is fixed to the tip end portion of the rotation shaft 5 by a bolt 14. The coil spring 7 is held in a compressed state between the hold plate 13 and a washer 15 disposed on a step portion formed at the base-side portion of the rotation shaft 5. One end of the coil spring 7 is pressure contacted with the hold plate 13 to thereby apply a frictional force to the hold plate 13. The other end of the coil spring 7 is formed straight as a hinged arm and a tip thereof is bent to form a tip projecting portion 16 extending toward the rope reel 6.

Figure 3:
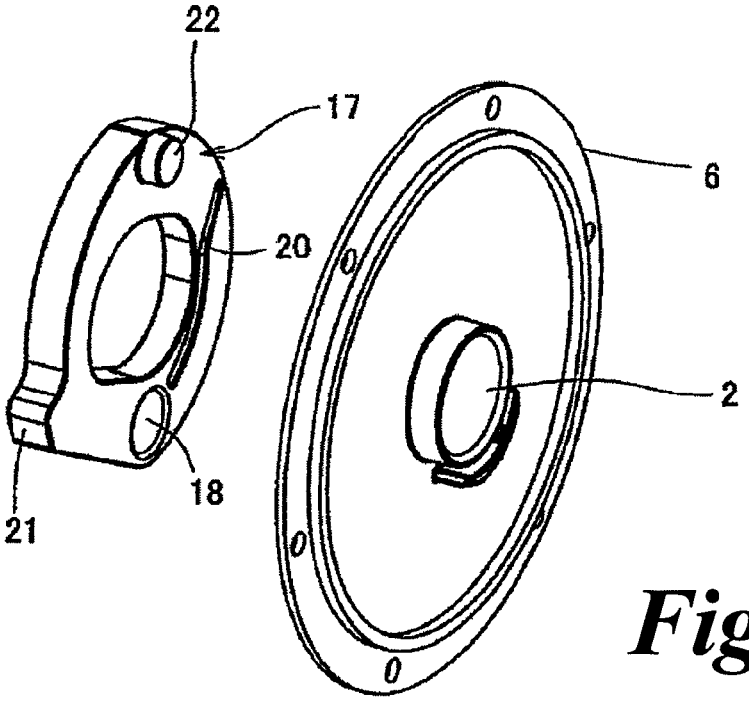
FIG. 3 perspectively shows a part of a rope reel and a ratchet in an exploded state.
Figure 4:
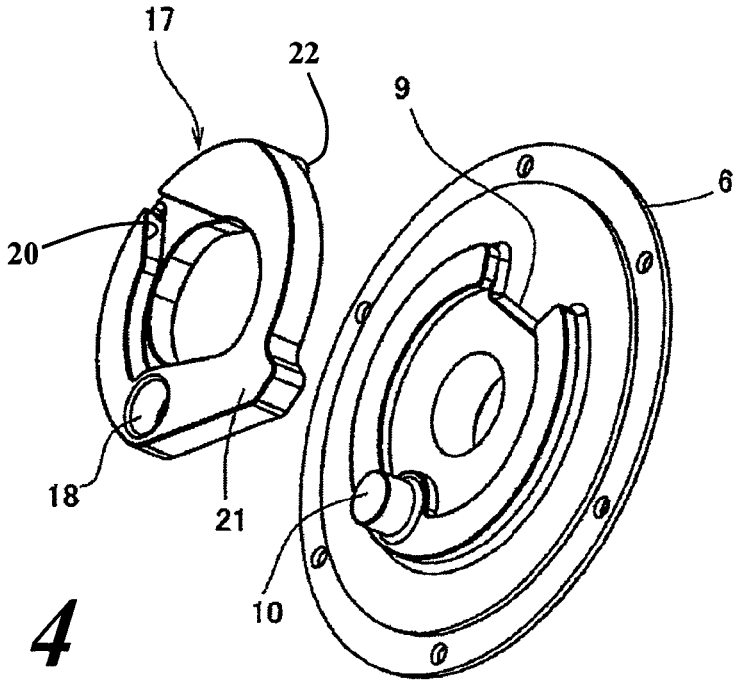
FIG. 4 perspectively shows the part of the rope reel and the ratchet, from the opposite direction with respect to FIG. 3.
Figure 6:
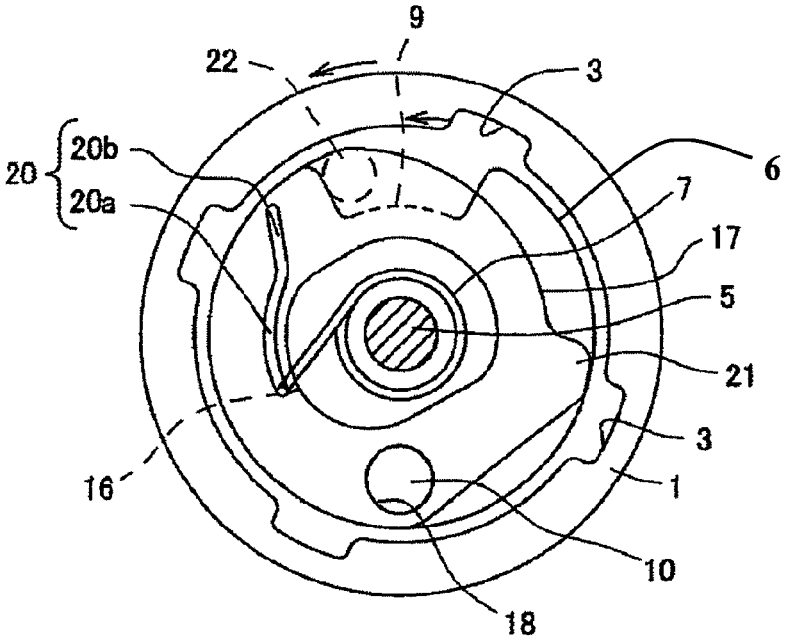
FIG. 6 shows an initial stage of the rotation of the rope reel.

A ratchet 17 is interposed between the hold plate 13 and the rope reel 6. As shown in FIGS. 3 and 4, the ratchet 17 is formed into a flat ring-like shape, and includes an oval space in its central portion. The ratchet 17 includes a shaft hole 18 as a center of the swinging movement with respect to the rope reel 6. Also, a guide groove 20 and an engagement pawl 21 are formed on the ratchet at positions opposite with each other so as to interpose the rotation shaft 5 therebetween. As shown in FIG. 6, the guide groove 20 includes a first guide portion 20*a* extending in the circumferential direction with respect to the rotation shaft 5 and a second guide portion 20*b* extending in the radial-outward direction with respect to the rotation shaft 5. The first and second portions continue with each other. The ratchet 17 further includes a projecting portion 22 at an opposite side with respect to the shaft hole 18.

In the guide groove 20, the length of the first guide portion 20*a* may be set such that a rotation angle $\alpha$ of the rope reel 6 to bring the ratchet 17 from the initial position shown in FIG.

Figure 7:
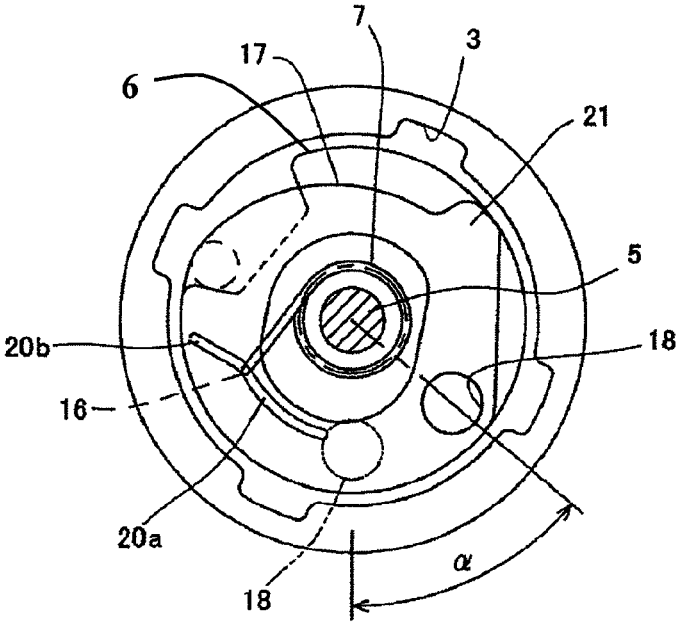
FIG. 7 shows an intermediate stage of the rotation of the rope reel.

6 into the swinging-start position shown in FIG. 7 in which the ratchet starts swinging from the rope reel 6 is equal to substantially 50° or more.

Figure 8:
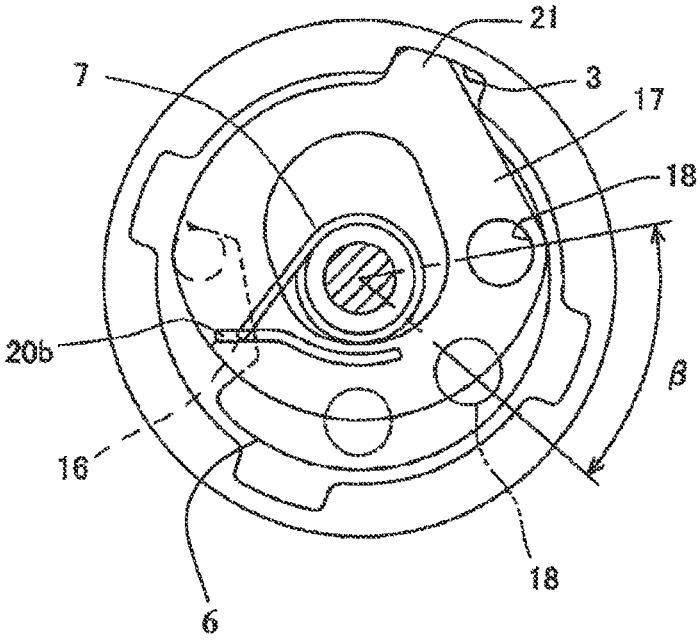
FIG. 8 shows an end stage of the rotation of the rope reel.

The length of the second guide portion 20*b* may be set such that a rotation angle β of the rope reel 6 to bring the ratchet 17 from the swinging-start position shown in FIG. 7 into the engagement position shown in FIG. 8 in which the ratchet 17 engages with the pulley 1 is equal to substantially 50° or more.

The guide groove 20 of the embodiment can be longer as compared with the conventional structure. The reason why the guide groove 20 can be made longer is that, in the ratchet 17, the guide groove 20 is disposed at an opposite side with respect to the engagement pawl 21 to interpose the rotation shaft 5 therebetween.

Figure 5:
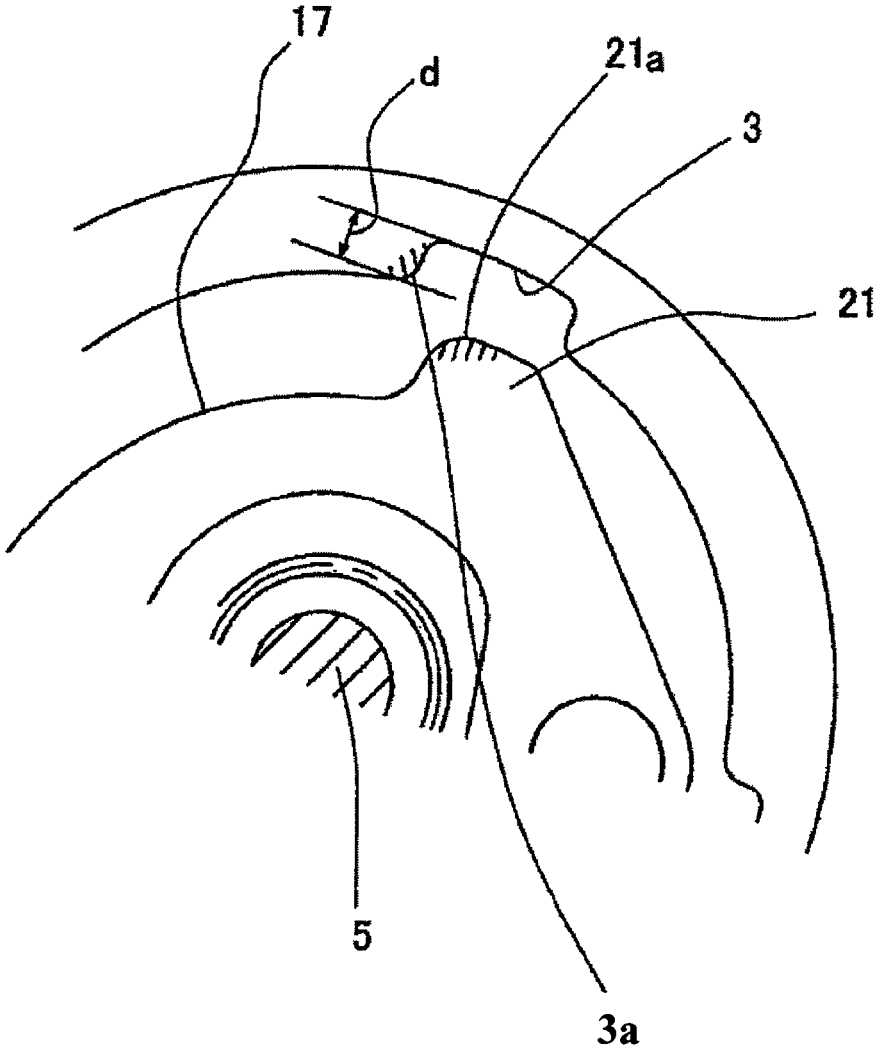
FIG. 5 enlargedly shows rounded portions respectively formed in an engagement groove of a pulley and an engagement pawl of the ratchet.

Further, as shown in FIG. 5, a tip end 21*a* of the engagement pawl 21 of the ratchet 17 may be formed into a rounded portion having a radius equal to substantially ½ of the depth d of the recessed groove 3 of the rope reel 6 or more. Also, an opening edge of the recessed groove 3 to be engaged with the engagement pawl 21 of the ratchet 17 may be formed into a rounded portion 3*a* having a radius equal to substantially ½ of the depth d of the recessed groove 3 or more.

The shaft hole 18 of the ratchet 17 is rotatably mounted on the short shaft 10 of the rope reel 6. The ratchet 17 is swingable with the short shaft 10 as a fulcrum, within a given angle specified by the recessed portion 9 formed in the surface of the rope reel 6. Also, to the guide groove 20 formed in the ratchet 17, the tip projecting portion 16 of the coil spring 7 is inserted.

Next, the operation of the recoil starter mechanism will be described.

FIG. 6 shows a state before the mechanism is operated. When the rope 12 is pulled by hand, the rope reel 6 rotates in a direction shown by an arrow, and the ratchet 17 mounted on the short shaft 10 of the rope reel 6 also rotates together. Here, since the coil spring 7 is compressed by the hold plate 13 (see FIG. 1), the coil spring 7 is prevented from rotating. Also, since the first guide portion 20*a* of the guide groove 20 extends in the circumferential direction with respect to the rotation shaft 5, as shown in FIG. 7, the tip projecting portion 16 of the coil spring 7 slides smoothly along the first guide portion 20*a* of the guide groove 20 of the ratchet 17 only with little sliding resistance until reaching its end. When the rope reel 6 rotates further, as shown in FIG. 8, the tip projecting portion 16 of the coil spring 7 moves along the second guide portion 20*b* of the guide groove 20 of the ratchet 17. However, since the second guide portion 20*b* extends in the radial-outward direction, great sliding resistance is applied between the tip projecting portion 16 and the second guide portion 20*b* of the guide groove 20 of the ratchet 17. Therefore, while the rope reel 6 rotates at the same speed, a braking force is applied to the engaged portions of the guide groove 20 of the ratchet 17 and the tip projecting portion 16 of the coil spring 7. Thus, the ratchet 17 starts swinging from the rope reel 6 with the short shaft 10 as a fulcrum so that the engagement pawl 21 thereof projects outwardly and engages with the recessed groove 3 of the pulley 1. Finally, the rope reel 6, the ratchet 17, the coil spring 7 and the pulley 1 rotate together, thereby starting the engine.

Next, when the hand is released from the rope 12, due to the restoring force of the return spring 6, the rope 7 is rewound onto the rope reel 6. In accordance with the reverse rotation of the rope reel 6, the ratchet 17 is caused to swing reversely about the short shaft 10 due to the sliding resistance between the second guide portion 20*b* of the guide groove 20 and the projecting portion 16 of the coil spring 7 the rotation of which is prevented by the frictional force applied from the hold plate 13. Thus, the engagement pawl 21 of the ratchet 17 disengages from the recessed groove 3 of the pulley 1, the tip projecting portion 16 of the coil spring 7 moves to the first guide portion 20*a* of the guide groove 20, and the projecting portion 22 of the ratchet 17 abuts against the recessed portion 9 of the rope reel 6 and returns to its initial position shown in FIG. 6.

If the rope is pulled in error during the backward movement of the snowmobile in which the engine reversely rotates, the engagement pawl 21 of the ratchet 17 attempts to project outwardly. However, before the portion 21 has been fully projected to be engaged with the recessed groove 3 of the pulley 1, the tip projecting portion 16 of the coil spring 7 must move first from one end to the other end of the first guide portion 20*a*, and next from one end to the other end of the second guide portion 20*b*. In this embodiment, in the ratchet 17, the guide groove 20 is formed at an opposite side with respect to the engagement pawl 21 through the rotation shaft 5 to have a sufficient length. Therefore, the distance (first guide portion 20*a*) for bringing the ratchet 17 from the initial position into the swinging-start position and the distance (second guide portion 20*b*) for bringing the ratchet 17 from the swinging-start position into the engagement state can be made longer, whereby the movement of the ratchet 17 can be made slow as compared with the conventional structure. Therefore, even when the rope is pulled in error while the engine reversely rotates, the ratchet 17 can be prevented from immediately swinging and engaging with the recessed groove 3. This can prevent the damage to the components and the occurrence of the safety problem.

In this embodiment, the rotation angle α of the rope reel 6 corresponding to a movement of the tip projecting portion 16 of the coil spring 7 from one end to the other end of the first guide portion 20*a* from which the ratchet 17 starts the swinging movement is set equal to substantially 50° or more. Thus, it takes relatively long time for the ratchet 17 to start the swinging movement after the rope 12 is pulled. Therefore, even when the rope 12 is pulled in error while the engine reversely rotates, the ratchet 17 is prevented from immediately starting the swinging movement.

Also, the rotation angle β of the rope reel 6 corresponding to a movement of the tip projecting portion 16 of the coil spring 7 from one end to the other end of the second guide portion 20*b* at which the ratchet 17 engages with the pulley 1, is set equal to substantially 50° or more. Therefore, even when the rope 12 is pulled in error while the engine reversely rotates, since the swinging movement of the ratchet 17 can be made slow with respect to the rotation of the rope reel 6, the engagement pawl 21 hardly enters the recessed groove 3 of the pulley 1.

As described above, since, by setting the first guide portion 20*a* to be longer, the time up to the start of the swinging movement of the ratchet can be increased, while the tip projecting portion 16 of the coil spring 7 stays in the first guide portion 20*a*, even when the rope reel 6 rotates, the ratchet engagement pawl 21 will not fly out. Also, by setting the second guide portion 20*b* to be longer, the swinging movement of the ratchet 17 can be made slow with respect to the rotation of the rope reel 6.

If the rotation angle α or β is set less than the above-mentioned range, the ratchet 17 may not be surely prevented from immediately starting the swinging movement, and the engagement pawl 21 may not be surely prevented from entering the recessed groove 3 of the pulley 1.

Figure 9:
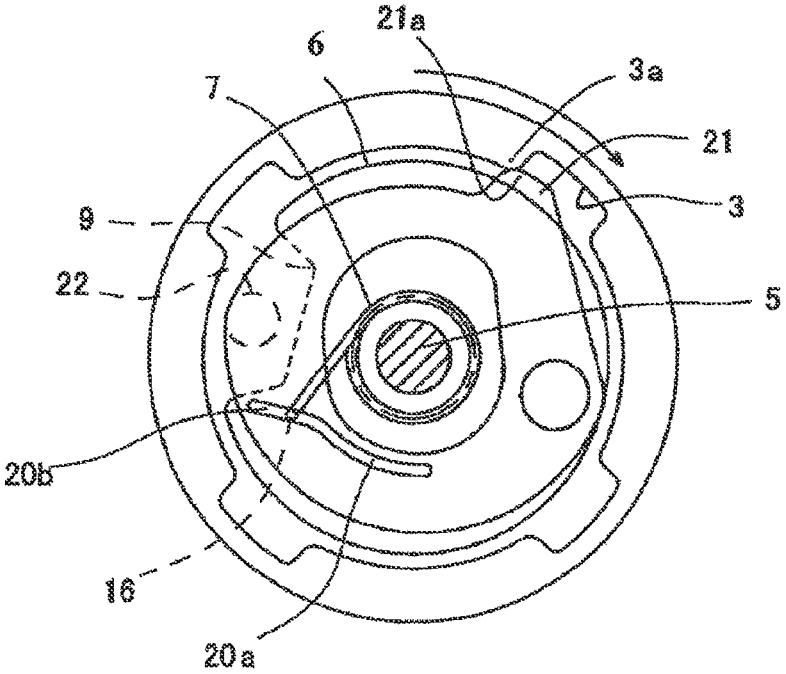
FIG. 9 shows a state where the engagement pawl of the ratchet collides with the engagement groove of the pulley.

Since the rounded portion 21*a* having a length equal to substantially ½ or more of the depth of the recessed groove 3 of the pulley 1 is formed in the engagement pawl 21 of the ratchet 17, and also since the rounded portion 3*a* having a length equal to substantially ½ or more of the depth of the recessed groove 3 is formed in the opening edge of the recessed portion 3 to be engaged with the engagement pawl 21, when the rope 12 is pulled in error while the engine reversely rotates to cause the swinging movement of the ratchet 17, as shown in FIG. 9, the rounded portion (tip end) 21*a* of the engagement pawl 21 collides with the rounded portion 3*a* of the recessed groove 3 of the pulley so that the tip end 21*a* is positively hit back. Thus, the engagement pawl 21 is prevented from entering the recessed groove 3, and the ratchet 17 and the pulley 1 are prevented from being engaged with each other.

That is, by setting the second guide portion 20*b* to be longer, the swinging movement of the ratchet 17 can be made slow with respect to the rotation of the rope reel 6 to thereby make it hard for the engagement pawl 21 to enter the recessed groove 3, and also, even when the rope 12 is further pulled such that the engagement pawl 21 slides on the inner peripheral surface of the pulley 1 to attempt to enter the recessed groove 3, the engagement pawl 21 is hit back by the rounded portion (tip end) 21*a* of the engagement pawl 21 and the rounded portion 3*a* of the recessed groove 3, thereby preventing the engagement pawl 21 entering the recessed groove 3.

When the tip end rounded portion 21 a of the engagement pawl 2 and the opening edge rounded portion 3*a* of the recessed groove 3 are less than substantially ½ of the depth of the recessed groove 3 of the pulley, an engagement of the engagement pawl 21 into the recessed groove 3 may not be prevented.

The invention claimed is:

1. A recoil starter mechanism, comprising:

a starter case;

a rotation shaft which projects from the starter case;

a rope reel which is rotatably mounted on the rotation shaft;

a coil spring which is wound on the rotation shaft, one end of the coil spring being formed into a tip projecting portion;

a hold plate which is provided at a tip end portion of the rotation shaft to thereby hold the coil spring toward a base-side portion of the rotation shaft; and a ratchet which is formed into a ring-like shape and interposed between the rope reel and the hold plate, the ratchet including:

a fulcrum around which the ratchet is swingable with respect to the rope reel;

a guide groove including a first guide portion extending in a circumferential direction with respect to the rotation shaft and a second guide portion extending in a radial-outward direction with respect to the rotation shaft, the tip projecting portion being slidably engaged with and displaceable back and forth in the guide groove during use with a sliding resistance therebetween; and an engagement pawl which is to be engaged with an engagement portion of a pulley to thereby start an engine, the guide groove and the engagement pawl being disposed on opposite sides of the rotation shaft such that the engagement pawl, the rotation shaft and the guide groove are aligned across a diameter of the ratchet.

2. The mechanism of claim 1, wherein the length of the first guide portion is set such that a rotation angle ($\alpha$) of the rope reel from an initial position to a swinging-start position in which the ratchet starts swinging from the rope reel is equal to substantially 50° or more.

3. The mechanism of claim 1, wherein a length of the second guide portion of the guide groove is set such that a rotation angle ($\beta$) of the rope reel from a swinging-start position in which the ratchet starts swinging from the rope reel to an engagement position in which the ratchet engages with the pulley is equal to substantially 50° or more.

4. The mechanism of claim 1, wherein the engagement portion of the pulley is formed as a recessed groove, wherein a tip end of the engagement pawl of the ratchet is formed into a rounded portion having a radius equal to substantially ½ of a depth (d) of the recessed groove or more, and wherein an opening edge of the recessed groove to be engaged with the engagement pawl of the ratchet is formed into a rounded portion having a radius equal to substantially ½ of the depth (d) of the recessed groove or more.

* * * * *